US007001208B2

(12) United States Patent
Huang

(10) Patent No.: US 7,001,208 B2
(45) Date of Patent: Feb. 21, 2006

(54) ELECTRICAL CONNECTOR FOR FLEXIBLE PRINTED CIRCUIT

(75) Inventor: Chien-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/936,259

(22) Filed: Sep. 7, 2004

(65) Prior Publication Data

US 2005/0042896 A1 Feb. 24, 2005

(30) Foreign Application Priority Data

Sep. 5, 2003 (TW) ..... 92216121 U

(51) Int. Cl.
*H01R 12/24* (2006.01)

(52) U.S. Cl. ..... 439/495; 439/260

(58) Field of Classification Search ..... 439/67, 439/495, 496, 26, 261, 267
See application file for complete search history.

(56) References Cited

U.S. PATENT DOCUMENTS

| | | | | |
|---|---|---|---|---|
| 5,882,223 | A * | 3/1999 | Igarashi | 439/495 |
| 6,345,998 | B1 * | 2/2002 | Lee | 439/260 |
| 6,533,606 | B1 * | 3/2003 | Yamane | 439/495 |
| 6,902,425 | B1 * | 6/2005 | Huang | 439/495 |
| 2005/0032428 | A1 * | 2/2005 | Huang | 439/607 |

* cited by examiner

*Primary Examiner*—Hae Moon Hyeon
(74) *Attorney, Agent, or Firm*—Wei Te Chung

(57) ABSTRACT

An FPC connector comprises an insulative housing defining an FPC insertion slot, a plurality of terminals loaded within the insulative housing in parallel relationship, a metallic shell covering the insulative housing and an actuator pivotably provided on the insulative housing. Each terminal has a contact beam extending into the FPC insertion slot and at least terminal has a pivot beam formed with a pivot portion for the actuator. The actuator is formed with a shaft portion to pivotably engage with the pivot portion. A strengthening metallic sheet is insert-molded in the actuator, and electrically and mechanically connects with the metallic shell.

15 Claims, 6 Drawing Sheets

ELECTRICAL CONNECTOR FOR FLEXIBLE PRINTED CIRCUIT

CROSS-REFERENCE TO RELATED APPLICATION

The present invention relates to a co-pending U.S. patent application Ser. No. 10/898,467 filed on Jul. 23, 2004, entitled "ELECTRICAL CONNECTOR FOR FLEXIBLE PRINTED CIRCUIT BOARD", invented by the same inventors as this patent application and assigned to the same assignee with this application.

BACKGROUND OF THE INVENTION

1. Field of the Invention

The present invention relates to an electrical connector, and more particularly to an electrical connector for a sheet-like connection member such as a flexible printed circuit or cable (FPC), a flexible flat cable (FFC) and so forth. All of these cables and circuits will be generally referred to as "FPC".

2. Description of the Prior Art

Electrical connectors for FFC are widely used in electronic devices such as mobile telephones, keyboards, hard disk drives and fax machines etc. U.S. Pat. Nos. 5,580,272 and 5,695,360 disclose a conventional FPC connector. The FPC connector disclosed therein comprises a housing, a plurality of terminals received in the housing, and an actuator rotatably mounted on the housing. Each terminal has a bifurcate contact section and a solder tail soldered onto a Printed Circuit Board (PCB) which the electrical connector is mounted. One end of the FPC is inserted into an opening defined in the housing, for electrically engaging with the bifurcate contact sections of the terminals. Thus, an electrical connection is established between the PCB and the FPC. With the miniaturization of electronic system and the development of high-frequency signal transmission technology, a shell is commonly required to the FPC connector for shielding purpose in order to ensure a reliable high-frequency signal transmission within the electronic system.

When the actuator is located at an open position, where the actuator is oriented substantially perpendicular to the insulative housing, one end of the FPC is inserted into the housing with a zero insertion force (ZIF) to align the terminals of the FPC connector with the pads of the FPC. Thereafter, the actuator is rotated from the open position to a closed position, where the actuator is oriented substantially parallel to the insulative housing, whereby pressing the electrical pads of the FPC toward the terminals of the FPC connector with necessary contact pressure for establishing electrical connection. However, the conventional actuator made of plastic material is too thin and frail to undertake a counter-pressure, which is adapted to provide a necessary contact pressure between the pads of the FPC and the terminals of the FPC connector, for a long term such that an adverse deformation of the actuator is not avoided. Furthermore, the conventional actuator is not reliably latched in the closed position only by the bifurcate contact section of the terminal, whereby the actuator might easily become loose due to shocking or misoperation.

In view of the above, a new electrical connector that overcome above-mentioned disadvantages is desired.

SUMMARY OF THE INVENTION

Accordingly, an object of the present invention is to provide an electrical connector for a flexible printed circuit (FPC), and particularly to an electrical connector having an Electronic Magnetic Interference (EMI) shielding to ensure reliable signal transmission between the FPC and the electrical connector.

To achieve the above objects, an FPC connector comprises an insulative housing defining an FPC insertion slot, a plurality of terminals loaded within the insulative housing in parallel relationship, a metallic shell covering the insulative housing and an actuator pivotably provided on the insulative housing. Each terminal has a contact beam extending into the FPC insertion slot and at least terminal has a pivot beam formed with a pivot portion for the actuator. The actuator is formed with a shaft portion to pivotably engage with the pivot portion. A strengthening metallic sheet is insert-molded in the actuator, and electrically and mechanically connects with the metallic shell.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
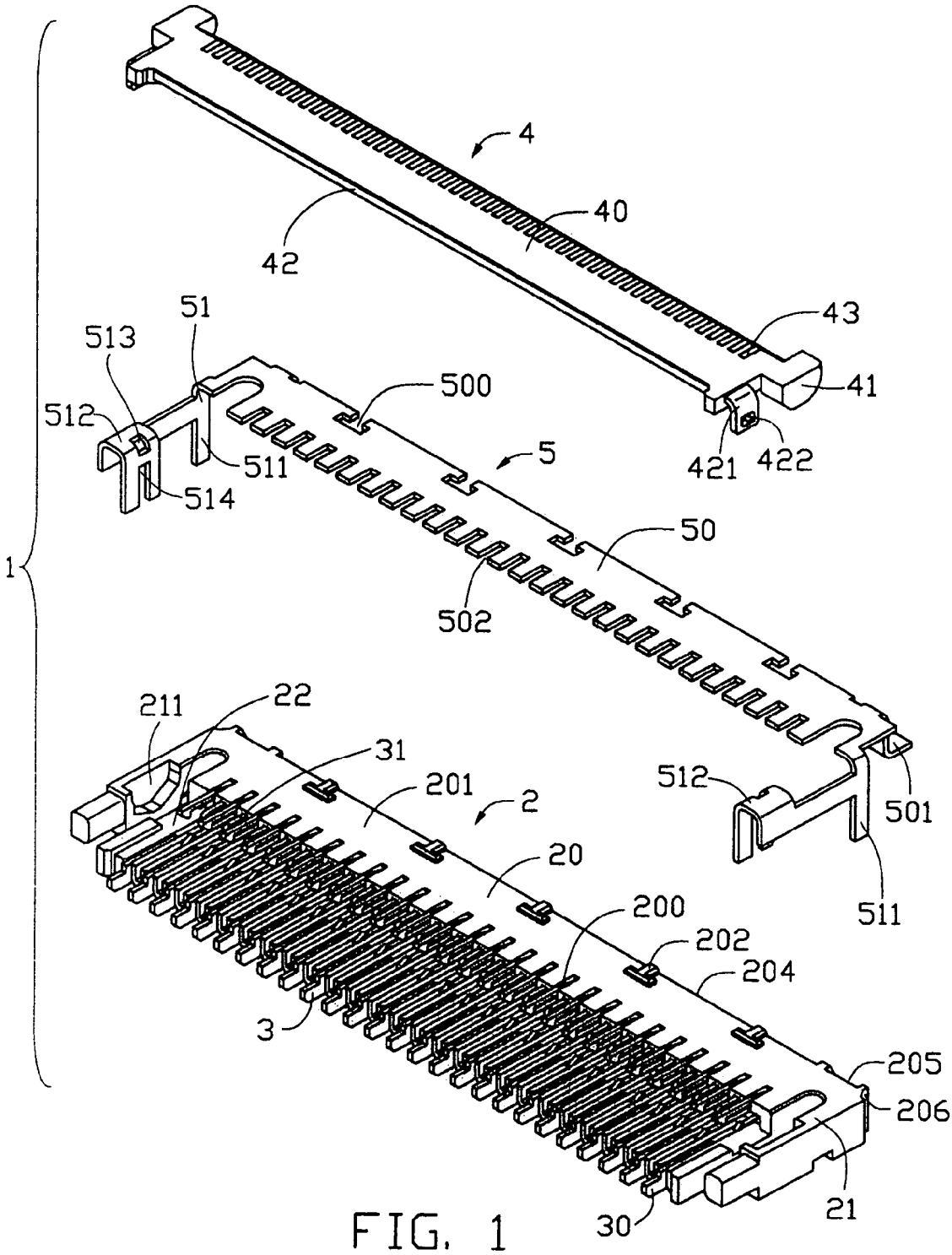
FIG. 1 is an exploded perspective view of an electrical connector in accordance with the present invention.
Figure 3:
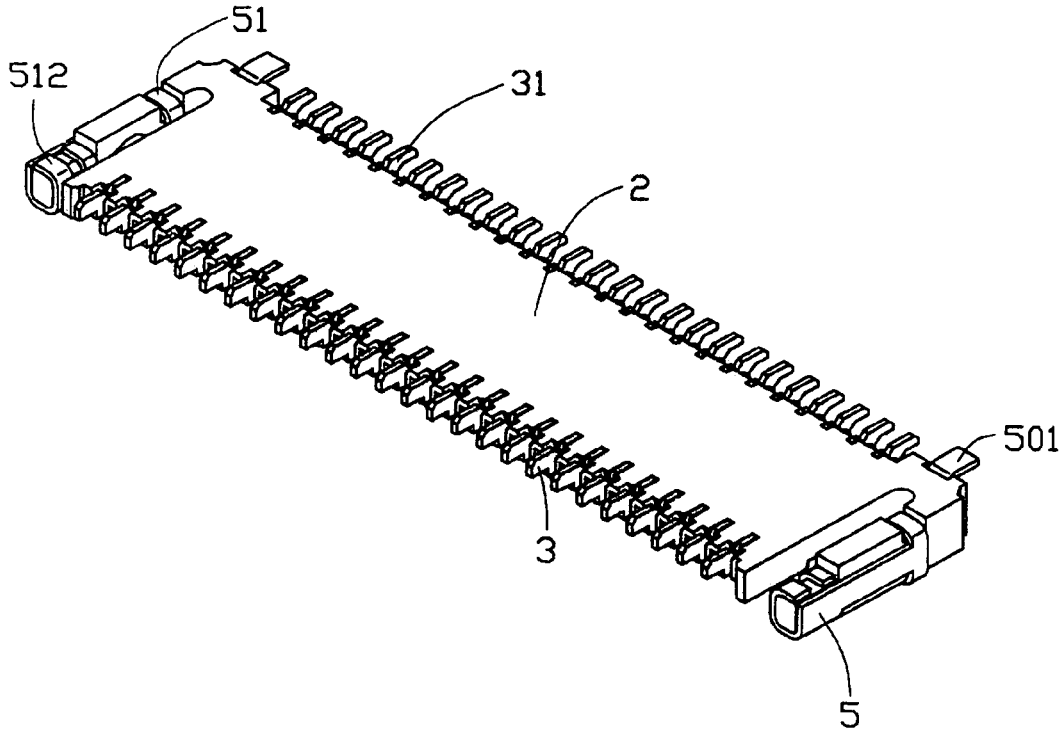
FIG. 3 is an assembled view of the electrical connector shown in FIG. 2.
Figure 4:
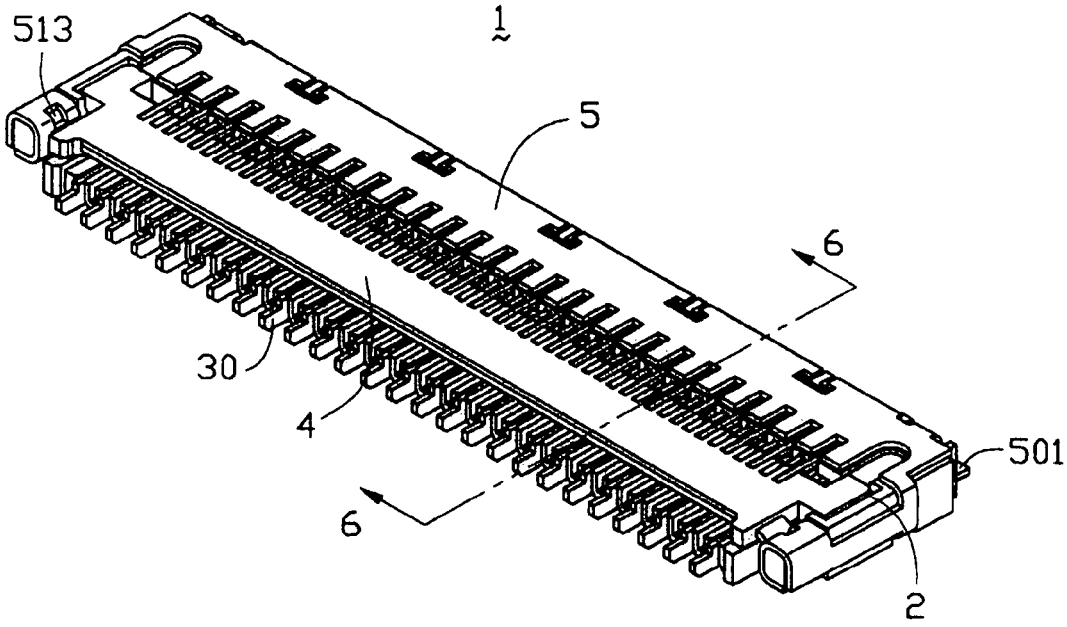
FIG. 4 is an assembled view of the electrical connector shown in FIG. 1.
Figure 5:
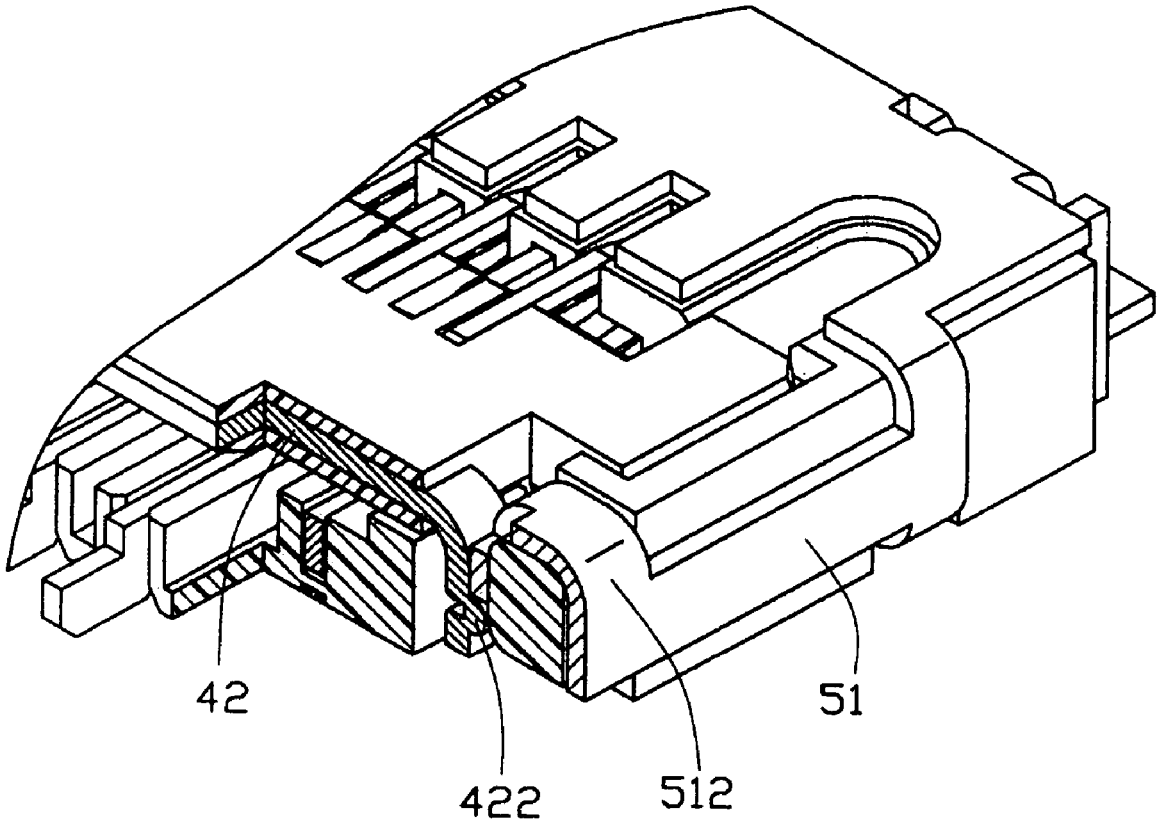
FIG. 5 is an partially enlarged perspective view of the electrical connector of FIG. 4, which is partly cut out.

Referring to FIGS. 1 and 3, an electrical connector 1 of the present invention is provided for electrical connecting a sheet-like connection member such as a flexible printed circuit or cable (FPC), a flexible flat cable (FFC) (not shown) etc. The electrical connector 1 comprises an insulative housing 2, a plurality of terminals 3 received in the insulative housing 2, an actuator 4 rotatably mounted on the insulative housing 2 and a shell 5 attached to the insulative housing 2.

Figure 2:
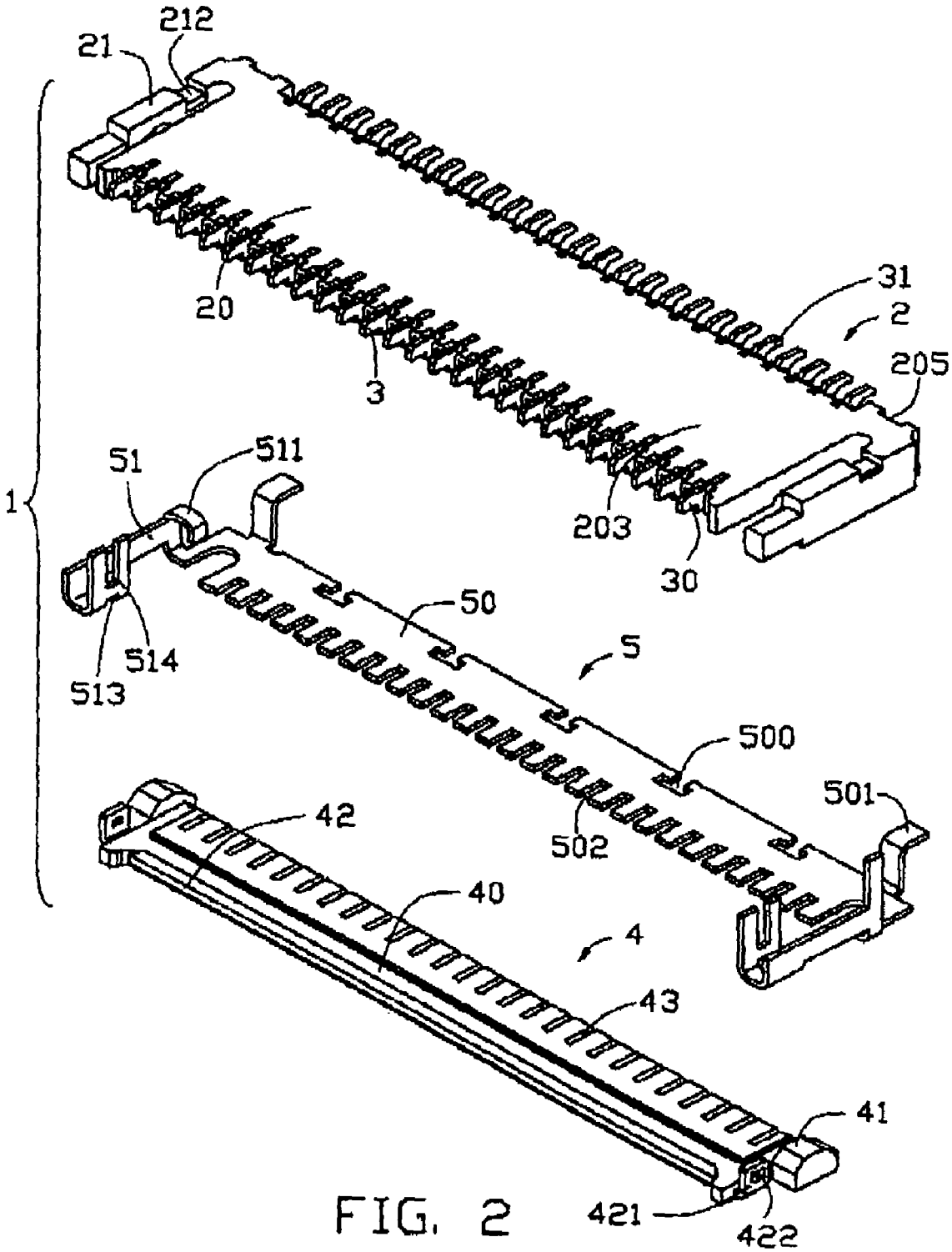
FIG. 2 is an exploded perspective view of the electrical connector shown in FIG. 1, but taken from another aspect.

Referring to FIGS. 1 and 2, the insulative housing 2 is configured with a longitudinal main body 20 and a pair of arms 21 extending and spaced from opposite sides of the main body 20, respectively. The main body 20 has a top surface 201, a bottom surface 203 opposite to the top surface 201, and a rear surface 204 connecting the top and the bottom surfaces 201, 203. In conjunction with reference to FIG. 6, an FPC insertion slot 22 is provided at a front portion of the top face 201 of the main body 20. A plurality of passageways 200 is defined in the rear surface 204 of the main body 20 and communicates with the FPC insertion slot 22 for receiving corresponding terminals 3 therein, respectively. The bottom surface 203 is adapted for abutting against one surface of a Printed Circuit Board (PCB) which the electrical connector 1 is mounted on. A plurality of T-shaped protrusions 202 are formed on the top surface 201 and discretely arranged along a longitudinal direction of the main body 20. Two pairs of projections 206 are provided at opposite end sides of the rear surface 204 respectively to define a groove 205 between each pair of projections 206. Each arm 21 defines a recess 211 in an inner side thereof and a cutout 212 in a bottom face thereof.

Figure 6:
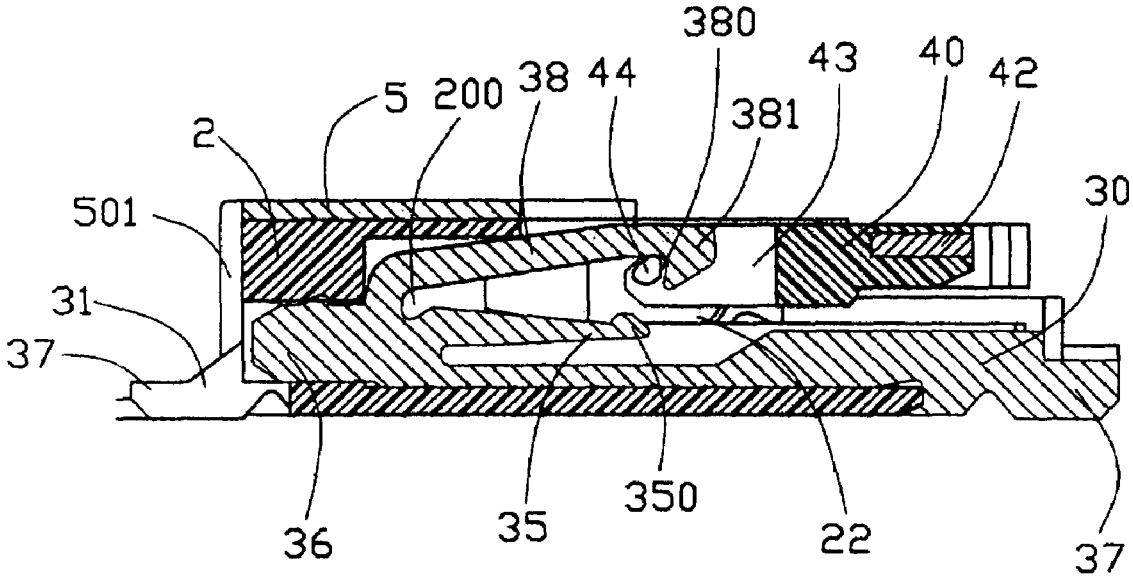
FIG. 6 is a cross-sectional view taken along line 6—6 of FIG. 4.

Referring to FIGS. 1 and 6, the terminals 3 has a plurality of first terminals 30 which is assembled into corresponding passageways 200 from a front face of the main body 20, and a plurality of second terminals 31 which is assembled into corresponding passageways 200 from the rear face 204 of the main body 20. The first terminals 30 are alternatively arranged with the second terminals 31 along the longitudinal direction of the main body 20. Each terminal 3 is provided with a contacting beam 35 having a contacting portion 350 projecting into the FPC insertion slot 22 of the main body 20 for electrically connecting with the inserted FPC, a retaining portion 36 securely retained in the passageway 200 and a solder tail 37 extending out of the main body 20 for electrically connecting the PCB which the electrical connector 1 is mounted on. Each first terminal 30 is formed with a pivot beam 38 extending substantially parallel in the upper side of the contact beam 35 in cantilever fashion. The pivot beam 38 is provided with a cut-out 380 in the lower edge at the tip end thereof to form a pivot portion 381 for the actuator 4.

Referring to FIGS. 1 and 6, the actuator 4 is formed into a plate form so as to open and close the upper portion of the FPC insertion slot 22. in order to engage with the pivot portion 381 of the pivot beam 38, sectionally circular shaft portions 44 are provided on a rear edge of the actuator 4. Each shaft portion 44 is formed by providing a through hole 43 corresponding to the pivot ann 38 on the rear edge of the actuator 4. By engaging the shaft portions 44 of the actuator 4 with the pivot portion 381 of the first terminals 30, the actuator 4 is pivotable between a closed position where the actuator 4 is oriented substantially parallel to the insulative housing 2 and an opened position where the actuator 4 is raised above the insulative housing 2. At this time, a pair of blocks 41 provided at opposite side ends of the rear edge of the actuator 4 is received in corresponding recesses 211 of the arm 21 and supported by the arm 21 of the insluative housing 2 for constantly maintaining the engaging condition the shaft portion 44 and the pivot portion 381.

A strengthening element 42 formed and stamped from a metal sheet is insert-molded in the actuator 4 with a pair of ears 421 extending out of opposite side face, adjacent to a front edge 40 of the actuator 4, and each formed with a dimple 422 in outer face thereof . The ears 421 of the strengthening element 42 are located in front of the shaft portions 44 of the actuator 4, and namely the ears 421 of the strengthening 42 is located in front of the pivot portion 381 of the pivot beam 38.

The shell 5 is engaged with the insulative housing 2 and has a planar plate portion 50, and a pair of clasping beam 51 extending forwardly from opposite ends of the plate portion 50. A plurality of "T" shaped securing slots 500 is defined in a back portion of the plate portion 50 for engaging with the respective T-shaped protrusions 202 of the insulative housing 2 to securing the plate portion 50 on the top surface 201 of the housing 2. A pair of grounding tabs 501 extends downwardly from a rear edge of the plate portion 50, partly received in the respective grooves 205 of the insulative housing 2. The grounding tabs 501 each have a cantilever configuration. A soldering portion (not labeled) is formed at a free end of the grounding tabs 501, for electrically connecting with the corresponding grounding pads of the PCB. A plurality of indents 502 is defined in a front edge of the plate portion 50 and aligned with the respective passageways 200, for avoiding the shell 5 contacting with the terminals 3.

A clasper 511 is provided on an end, adjacent to the plate portion 50, of the clasping beam 51 and a latching portion 512 is provided at a free end of the clasping beam 51. The clasper 511 is deformed and received in the recess 212 of the arm 21 to tightly clasp the arm 21. The latching portion 512 is deformed to tightly clasp the free end of the arm 21. Thus, the clasping beam 51 is securely attached to the arm 21. The latching portion 512 defines a first positioning hole 513 corresponding to the dimple 422 of the strengthening element 42 and a second position hole 514 located below and aligned with the first positing hole 513.

In use, the FPC is inserted into the FPC insertion slot 22 of the insulative housing 2 with zero insertion force (ZIF) from a front face of the insulative housing 2 while the actuator 4 is located at the open position so that the pads of the FPC are aligned with the contacting beam 35. Then, the actuator 4 is rotated downwardly from the open position until the dimple 422 provided in the ears 421 latches into the first position hole 513, thereby the strengthening element 42 is electrically and mechanically connecting with the shell 5 to establish an integrated shielding layer for the electrical connector 1.

As the actuator 4 is further pushed in the state described above, the dimple 422 provided in the ears 421 slides downwardly into the second position hole 514 so that a pressing surface of the actuator 4 urges the pads of the FPC to but against the contacting beam 35 of the terminals 3. The contacting beam 35 is elastically deformed and the contacting portion 351 and the FPC are contact with necessary contact pressure for establishing electrical connection. The strengthening element 42 insert-molded in the actuator 4 strengthen the actuator 4 in structure to prevent the actuator 4, which provides a necessary contact pressure between the contacting portion 350 and the pads of the FPC, from being deformed. The one operating the actuator 4 can conclude whether the actuator 4 completely engages with the insulative housing 2 by a click generated during the dimple 422 provided in the ear 421 sliding into the second position hole 514. The latching position of the dimple 422 provided in the ears 421 and the second position hole 514 provided in the latching portion 512 is adjacent to the front edge 40 of the actuator 4 and located in front of the engagement position of the pivot portion 381 of the first terminals 30 and the shaft portion 44 of the actuator 4. As a result, the actuator 4 is firmly situated at the closed position, and liability mechanical and electrical engagement between the FPC and the connector 1 is attained.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. A flexible printed circuit (FPC) connector comprising:

an insulative housing defining an FPC insertion slot;

a plurality of terminals loaded within the insulative housing in parallel relationship wit a predetermined pitch, each terminal having a contact beam extending into the FPC insertion slot and at least one terminal having a pivot beam formed with a pivot portion;

a metallic shell covering the insulative housing; and an actuator pivotably mounted on the insulative housing and being formed with a shaft portion to engage with the pivot portion of the pivot beam, the actuator having a strengthening element extending along a lengthwise direction of the actuator and electrically and mechanically connectable with the metallic shell.

2. The FPC connector as claimed in claim 1, wherein the strengthening element is formed and stamped from a metallic sheet.

3. The FPC connector as claimed in claim 2, wherein the strengthening element is insert-molded in the actuator.

4. The FPC connector as claimed in claim 2, wherein the metallic shell is formed with at least one clasping beam attached to the insulative housing, and wherein the strengthening element is formed with at least an ear extending out of the main body of the actuator to electrically and mechanically connecting with the clasping beam of the metallic shell.

5. The FPC connector as claimed in claim 4, wherein the clasping beam of the metallic shell defines one position hole, and wherein the ear of the strengthening element is formed with a dimple latched with the one position hole.

6. The FPC connector as claimed in claim 5, wherein the clasping beam of the metallic shell defines another position hole located above and aligned with the one position hole to latch with the dimple of the ear of the strengthening element.

7. The FPC connector as claimed in claim 1, wherein a connecting position of the metallic shell and the strengthening element is located in front of an engaging position of the pivot portion of the pivot arm and the shaft portion of the actuator.

8. The FPC connector as claimed in claim 1, wherein the actuator is formed with at least a block at a side thereof supported by the insulative housing.

9. The FPC connector as claimed in claim 1, wherein some terminals are assembled from a front face of the insulative housing, and wherein the other terminals are assembled from a rear face of the insualtive housing.

10. The FPC connector as claimed in claim 1, wherein the metallic shell is formed with a grounding tab.

11. The FPC connector as claimed in claim 1, wherein the metallic shell defines a plurality of securing slots, and wherein the insulative housing is formed with a plurality of protrusions for engaging with corresponding securing slots.

12. The FPC connector as claimed in claim 1, wherein the actuator is pivotable between a closed position, where conductors of the FPC are urged by the actuator to contact with corresponding contact beams of the terminals with necessary contact pressure, and an open position, where the actuator is raised above the insulative housing.

13. A flexible printed circuit (FPC) connector assembly comprising:

an insulative housing defining an FPC insertion slot along a lengthwise direction thereof;

a terminal set including a plurality of terminals disposed within the insulative housing in parallel relationship with a predetermined pitch, each terminal having a contact beam extending into the FPC insertion slot;

a metallic shell covering the insulative housing; and an elongated actuator pivotably mounted on the insulative housing and being formed with a pivotal portion at one end, along thereof a front-to-back direction perpendicular to said lengthwise direction, to engage with at least one of the housing and the terminal set during rotation; wherein the actuator includes a metallic strengthening element embedded therein and extending along the lengthwise direction and defining at two opposite ends, along said lengthwise direction, two engagement sections electrically and mechanically connectable with the metallic shell.

14. A flexible printed circuit (FPC) connector assembly comprising:

an insulative housing defining an FPC insertion slot along a lengthwise direction thereof;

a plurality of terminals disposed within the insulative housing in parallel relationship with a predetermined pitch, at least one terminal having a contact beam extending into the FPC insertion slot;

a metallic shell covering the insulative housing; and an elongated actuator pivotably mounted on the insulative housing and being formed with a pivotal portion at one end, along thereof a front-to-back direction perpendicular to said lengthwise direction, to engage with at least one of the housing and the terminals during rotation; wherein the actuator includes a metallic strengthening element extending along the lengthwise direction and electrically connectable wit the metallic shell.

15. The FPC connector assembly as claimed in claim 14, wherein the strengthening element defines two engagement sections at two apposite ends along the lengthwise direction, which are electrically and mechanically connectable with the metallic shell.

* * * * *